US006450628B1

(12) United States Patent
Jeanmaire et al.

(10) Patent No.: US 6,450,628 B1
(45) Date of Patent: Sep. 17, 2002

(54) CONTINUOUS INK JET PRINTING APPARATUS WITH NOZZLES HAVING DIFFERENT DIAMETERS

(75) Inventors: David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 65 days.

(21) Appl. No.: 09/892,831

(22) Filed: Jun. 27, 2001

(51) Int. Cl.[7] ..... B41J 2/02
(52) U.S. Cl. ..... 347/75; 347/82
(58) Field of Search ..... 347/15, 73, 74, 347/75, 82, 43, 12, 40

(56) References Cited

U.S. PATENT DOCUMENTS

| | | | | | |
|---|---|---|---|---|---|
| 1,941,001 | A | | 12/1933 | Hansell | 178/96 |
| 3,373,437 | A | * | 3/1968 | Sweet et al. | 347/74 |
| 3,416,153 | A | | 12/1968 | Hertz et al. | 347/73 |
| 3,701,998 | A | | 10/1972 | Mathis | 347/75 |
| 3,709,432 | A | | 1/1973 | Robertson | 239/4 |
| 3,878,519 | A | | 4/1975 | Eaton | 347/75 |
| 4,190,844 | A | | 2/1980 | Taylor | 397/82 |
| 4,346,387 | A | | 8/1982 | Hertz | 347/75 |
| 4,350,986 | A | * | 9/1982 | Yamada | 347/77 |
| 4,638,382 | A | | 1/1987 | Sochor | 360/68 |
| 4,914,522 | A | | 4/1990 | Duffield et al. | 358/296 |
| 5,224,843 | A | | 7/1993 | van Lintel | 417/413.2 |
| 5,892,524 | A | | 4/1999 | Silverbrook | 347/15 |
| 6,030,065 | A | * | 2/2000 | Fukuhata | 347/15 |
| 6,079,821 | A | | 6/2000 | Chwalek et al. | 347/82 |

* cited by examiner

*Primary Examiner*—Lamson Nguyen
(74) *Attorney, Agent, or Firm*—Milton S. Sales

(57) ABSTRACT

An apparatus for printing an image is provided. The apparatus includes a print head with nozzles of differing diameters. This allows multiple printing drop sizes for multi-level printing, thus achieving higher print quality at the same resolution. Additionally, each nozzle is operable to selectively create a stream of ink droplets having a plurality of volumes. The apparatus also includes a droplet deflector having a gas source. The gas source is positioned at an angle with respect to the stream of ink droplets and is operable to interact with the stream of ink droplets thereby separating ink droplets into printing and non-printing paths.

12 Claims, 5 Drawing Sheets

CONTINUOUS INK JET PRINTING APPARATUS WITH NOZZLES HAVING DIFFERENT DIAMETERS

CROSS REFERENCE TO RELATED APPLICATIONS

Reference is made to commonly assigned, co-pending U.S. patent applications Ser. No. 09/750,946, entitled "printhead having gas flow ink droplet separation and method of diverging ink droplets" filed in the names of D. L. Jeanmaire et al. on Dec. 28, 2000, and Ser. No. 09/861,692, entitled "continuous ink-jet printing method and apparatus with nozzle clusters " filed in the name of D. L. Jeanmaire on May 21, 2001.

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color ink jet printing capability is accomplished by one of two technologies. Both require independent ink supplies for each of the colors of ink provided. Ink is fed through channels formed in the print head. Each channel includes a nozzle from which droplets of ink are selectively extruded and deposited upon a receiving medium. Typically, each technology requires separate ink delivery systems for each ink color used in printing. Ordinarily, the three primary subtractive colors, i.e. cyan, yellow and magenta, are used because these colors can produce, in general, up to several million perceived color combinations.

The first technology, commonly referred to as "drop-on-demand" ink jet printing, typically provides ink droplets for impact upon a recording surface using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

Piezoelectric actuators, such as that disclosed in U.S. Pat. No. 5,224,843, issued to vanLintel, on Jul. 6, 1993, have a piezoelectric crystal in an ink fluid channel that flexes when an electric current flows through it forcing an ink droplet out of a nozzle. The most commonly produced piezoelectric materials are ceramics, such as lead zirconate titanate, barium titanate, lead titanate, and lead metaniobate.

In U.S. Pat. No. 4,914,522, which issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print media.

Typically, continuous ink jet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,416,153, issued to Hertz et al. on Oct. 6, 1963, discloses a method of achieving variable optical density of printed spots in continuous ink jet printing using the electrostatic dispersion of a charged droplet stream to modulate the number of droplets which pass through a small aperture.

U.S. Pat. No. 3,878,519, issued to Eaton on Apr. 15, 1975, discloses a method and apparatus for synchronizing droplet formation in a liquid stream using electrostatic deflection by a charging tunnel and deflection plates.

U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, issued to Drake et al. on Jan. 20, 1987, discloses a continuous ink jet print head that utilizes constant thermal pulses to agitate ink streams admitted through a plurality of nozzles in order to break up the ink streams into droplets at a fixed distance from the nozzles. At is point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet print heads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous ink jet printer having a first pneumatic deflector for deflecting non-printed ink droplets to a catcher and a second pneumatic deflector for oscillating printed ink droplets. A print head supplies a filament of working fluid that breaks into individual ink droplets. The ink droplets are then selectively deflected by a first pneumatic deflector, a second pneumatic deflector, or both. The first pneumatic deflector is an "on/off" type having a diaphragm that either opens or closes a nozzle depending on one of two distinct electrical signals received from a central control unit. This determines whether the ink droplet is to be printed or non-printed The second pneumatic deflector is a continuous type having a diaphragm that varies the amount that a nozzle is open, depending on a varying electrical signal received the central control unit. This oscillates printed ink droplets so that characters may be printed one character at a time. If only the first pneumatic deflector is used, characters are created one line at a time, being built up by repeated traverses of the print head.

While this method does not rely on electrostatic means to affect the trajectory of droplets, it does rely on the precise control and timing of the first ("ON/OFF") pneumatic deflector to create printed and nonprinted ink droplets. Such a system is difficult to manufacture and accurately control, resulting in at least the ink droplet build up discussed above. Furthermore, the physical separation or amount of discrimination between the two droplet paths is erratic due to the precise timing requirements, increasing the difficulty of controlling printed and non-printed ink droplets and resulting in poor ink droplet trajectory control.

Additionally, using two pneumatic deflectors complicates construction of the print head and requires more components. The additional components and complicated structure require large spatial volumes between the print head and the media, increasing the ink droplet trajectory distance. Increasing the distance of the droplet trajectory decreases droplet placement accuracy and affects the print image quality. Again, there is a need to minimize the distance that the droplet must travel before striking the print media in order to insure high quality images.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher. While the ink jet printer disclosed in Chwalek et al. works extremely well for its intended purpose, it is best adapted for use with inks that have a large viscosity change with temperature.

Each of the above-described ink jet printing systems has advantages and disadvantages. However, print heads which are low-power and low-voltage in operation will be advantaged in the marketplace, especially in page-width arrays. U.S. patent application Ser. No. 09/750,946, filed in the names of D. L. Jeanmaire et al. on Dec. 28, 2000, discloses continuous-jet printing wherein nozzle heaters are selectively actuated at a plurality of frequencies to create the stream of ink droplets having the plurality of volumes. A gas stream provides a force separating droplets into printing and non-printing paths according to drop volume. While this process consumes little power, and is suitable for printing with a wide range of inks, the apparatus described does not easily create ink drops of variable size where the size is varied image-wise on a pixel-by-pixel basis.

Often it is desirable to print with multiple drop sizes to achieve multi-level printing, allowing higher print quality at the same resolution. One solution to this problem is the use of multiple rows of nozzles on the print head as disclosed in U.S. Pat. No. 5,892,524, which issued to Silverbrook in 1999, for a drop-on-demand print head. The concept of multiple rows of nozzles has not been implemented, however, in a continuous ink jet printer, due to the difficulty of dealing with small deflection angles, multiple separation fields, and the resultant need for multiple droplet catchers required for continuous systems. An example of this can be seen in a printing apparatus described in U.S. Pat. No. 3,701,998, which issued to Mathis in 1972, and discloses two rows of nozzles and multiple ink catcher structures.

It can be seen that there is an opportunity to provide an improvement to continuous ink jet printers. The features of low-power and low-voltage print head operation are desirable to retain, while providing for multi-level printing, without the complexity of structure replication.

SUMMARY OF THE INVENTION

An object of the present invention is to provide for multi-level printing in printers with print heads in which heat pulses are used to break up fluid into drops having a plurality of volumes, and which use a gas flow to separate the drops along printing and non-printing paths. This introduction of multi-level printing improves the quality of the image on the receiver media.

According to a feature of the present invention, an apparatus for printing an image comprises a print head having a first group of nozzles from which a stream ink droplets of a first volume are emitted, and a second group of nozzles from which a stream of ink droplets of a second volume are emitted. The said second volume is less than the first volume. A mechanism is associated with each group of nozzles and is adapted to independently adjust the volume of the ink droplets emitted by the nozzles. The mechanism has a first state, wherein the volumes of the droplets emitted from the first and second groups are of the first and second volume, respectively, and a second state wherein the volumes of the droplets emitted from the first and second groups are of a third and forth volume, respectively; the third and forth volumes being smaller than said first and second volumes. A droplet deflector is adapted to produce a force on the emitted droplets, said force being applied to the droplets at an angle with respect to the stream of ink droplets to cause ink droplets having either of the first and second volumes to move along a first set of paths, and ink droplets having either of the third and forth volumes to move along a second set of paths. An ink catcher is positioned to allow drops moving along one of the first and second sets of paths to move unobstructed past the catcher, while intercepting drops moving along the other of said first and second sets of paths.

According to another feature of the present invention, an ink droplet forming mechanism has two rows of nozzles operable to selectively create streams of ink droplets having a plurality of volumes. Additionally, a droplet deflector having a gas source is positioned at an angle with respect to the stream of ink droplets and is operable to interact with the stream of ink droplets. The interaction separates ink droplets having one volume from ink droplets having other volumes. The large separation angles between printing and non-printing droplet paths that can be obtained using this printing method (as opposed to electrostatic means of droplet separation common in the prior art) enables the use of a single gas flow and ink catcher assembly, thereby simplifying the apparatus.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
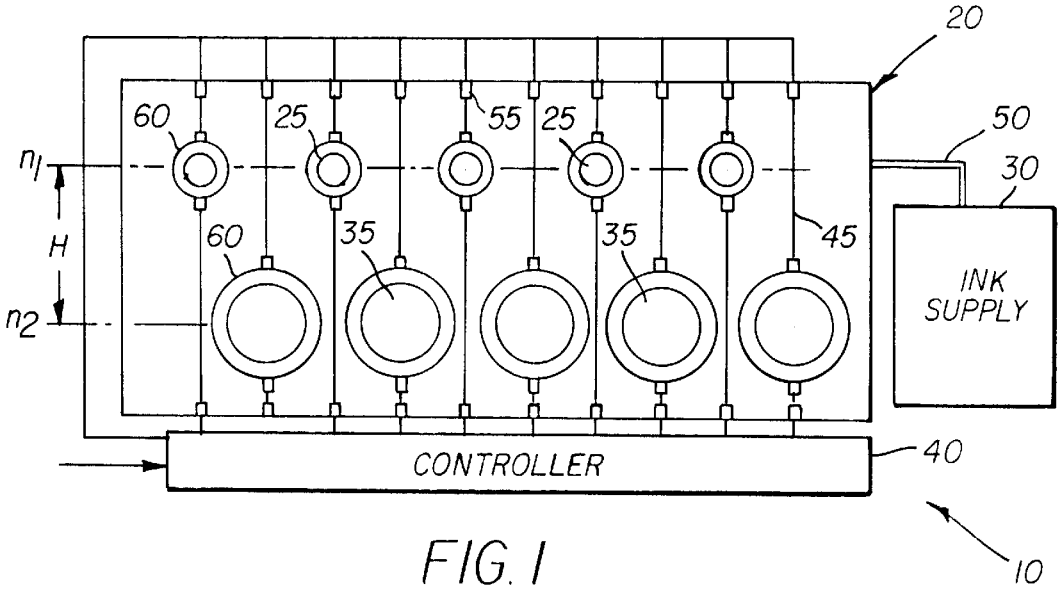
FIG. 1 is a schematic plan view of a print head made in accordance with a preferred embodiment of the present invention.

FIG. 1 shows an ink droplet forming mechanism 10 of a preferred embodiment of the present invention, including a print head 20, at least one ink supply 30, and a controller 40. Although ink droplet forming mechanism 10 is illustrated schematically and not to scale for the sake of clarity, one of ordinary skill in the art will be able to readily determine the specific size and interconnections of the elements of a practical apparatus according to a specific desired application.

In a preferred embodiment of the present invention, print head 20 is formed from a semiconductor material, such as for example silicon, using known semiconductor fabrication techniques (CMOS circuit fabrication techniques, micro-electro mechanical structure (MEMS) fabrication techniques, etc.). However, print head 20 may be formed from any materials using any fabrication techniques conventionally known in the art.

As illustrated in FIG. 1, at least two rows of nozzles ($n_1$ and $n_2$) of at least one nozzle each are formed on print head 20 and are separated by distance H, which distance H can range from about 20 micrometers to about 10 mm. In a preferred embodiment, H is preferably about 50 micrometers to about 150 micrometers. The nozzles in row $n_2$, designated by reference numeral 35, have diameters equal to or larger than the nozzles in row $n_1$, designated by reference numeral 25. For example, nozzles 25 may be, say, 9 micrometers in diameter and nozzles 35 may be, say, 16 micrometers in diameter. Nozzles 25 and nozzles 35 are in fluid communication with ink supply 30 through ink passage 50, also formed in print head 20. Single color printing, such as so-called black and white, may be accomplished using a single ink supply 30 and single sets of nozzles 25 and 35. In order to provide color printing using two or more ink colors, print head 20 may incorporate additional ink supplies in the manner of supply 30 and corresponding sets of nozzles 25 and 35.

A set of heaters 60 are at least partially formed or positioned on print head 20 around corresponding nozzles 25 and 35. Although heaters 60 may be disposed radially away from the edge of corresponding nozzles 25 and 35, they are preferably disposed close to corresponding nozzles 25 and 35 in a concentric manner. In a preferred embodiment, heaters 60 are formed in a substantially circular or ring shape. However, heaters 60 may be formed in a partial ring, square, etc. Heaters 60 in a preferred embodiment consist principally of an electric resistive heating element electrically connected to electrical contact pads 55 via conductors 45.

Conductors 45 and electrical contact pads 55 may be at least partially formed or positioned on print head 20 to provide an electrical connection between controller 40 and heaters 60. Alternatively, the electrical connection between controller 40 and heaters 60 may be accomplished in any well-known manner. Controller 40 is typically a logic controller, programmable microprocessor, etc. operable to control many components (heaters 60, ink droplet forming mechanism 10, etc.) in a desired manner.

Figure 2:
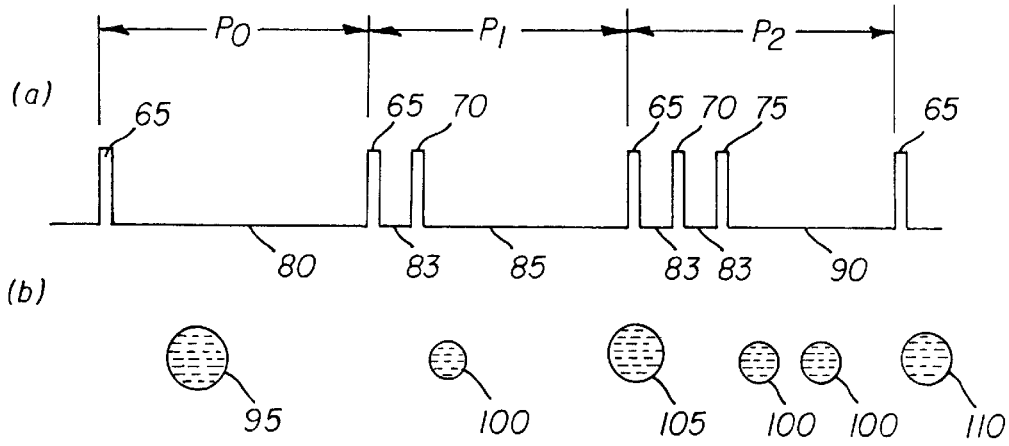
FIG. 2 is a diagram illustrating a frequency control of a heater used in the preferred embodiment FIG. 1.

FIG. 2 is a schematic example of the electrical activation waveform provided by controller 40 to heaters 60. A similar method is used to operate both rows of nozzles $n_1$ and $n_2$. In general, rapid pulsing of heaters 60 forms small ink droplets, while slower pulsing creates larger drops. In the first example presented here, small ink droplets are to be used for marking the image receiver, while larger, non-printing droplets are captured for ink recycling.

In a preferred implementation, multiple drops per nozzle per image pixel are created. Periods $P_0$, $P_1$, $P_2$, etc. are the times associated with the printing of associated image pixels, the subscripts indicating the number of printing drops to be created during the pixel time. The schematic illustration shows the drops that are created as a result of the application of the various waveforms. A maximum of two small printing drops is shown for simplicity of illustration, however, it will be understood that the reservation of more time for a larger count of printing drops is within the scope of this invention.

In the drop formation for each image pixel, a non-printing large drop 95, 105, or 110 is always created, in addition to a selectable number of small, printing drops. The waveform of activation of heater 60 for every image pixel begins with electrical pulse time 65, typically from about 0.1 microsecond to about 10 microseconds in duration, and more preferentially about 0.5 microsecond to about 1.5 microseconds. The further (optional) activation of heater 60, after delay time 83, with an electrical pulse 70 is conducted in accordance with image data wherein at least one printing drop 100 is required as shown for interval $P_1$. For cases where the image data requires that still another printing drop be created as in interval $P_2$, heater 60 is again activated after delay 83, with a pulse 75. Heater activation electrical pulse times 65, 70, and 75 are substantially similar, as are all delay times 83. Delay time 83 is typically about 1 microsecond to about 100 microseconds, and more preferentially, from about 3 microseconds to about 6 microseconds. Delay times 80, 85, and 90 are the remaining times after pulsing is over in a pixel time interval P and the start of the next image pixel. All small, printing drops 100 are the same volume. However, the volume of the larger, non-printing drops 95, 105 and 110, varies depending on the number of small drops 100 created in the pixel time interval P; as the creation of small drops takes mass away from the large drop during the pixel time interval P. The delay time 90 is preferably chosen to be significantly larger than the delay time 83, so that the volume ratio of large non-printing-drops 110 to small printing-drops 100 is a factor of about 4 or greater.

Figure 3:
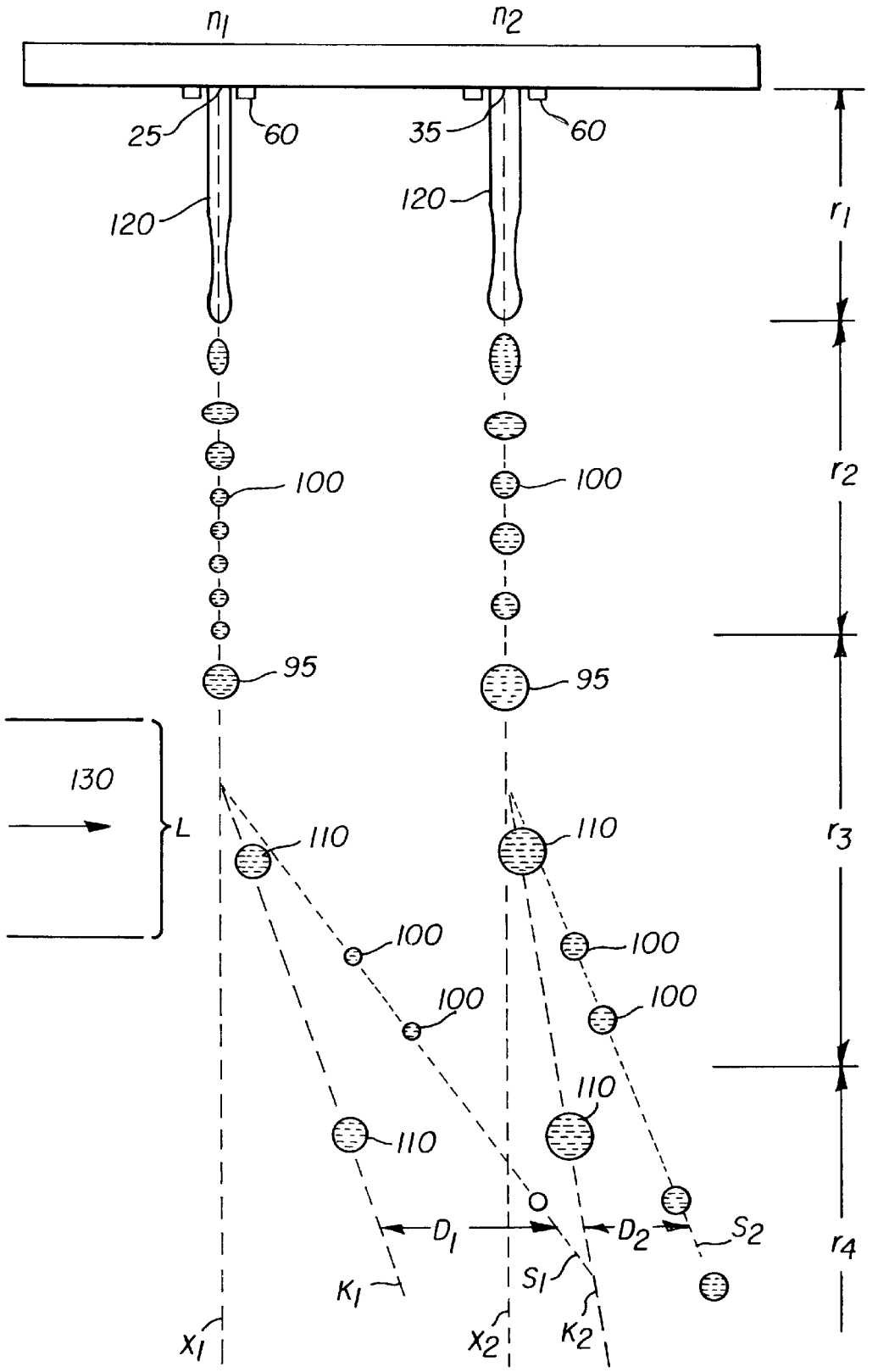
FIG. 3 is a cross-sectional view of an ink jet print head made in accordance with the preferred embodiment of the present invention.

Referring to FIG. 3, the operation of print head 20 in a manner such as to provide an image-wise modulation of drop volumes, as described above, is coupled with an gas-flow discrimination means which separates droplets into printing or non-printing paths according to drop volume. Ink is ejected through nozzles 25 and 35 in print head 20, creating a filament of working fluid 120 moving substantially perpendicular to print head 20 along axes $X_1$ and $X_2$, respectively. The physical region over which the filament of working fluid is intact is designated as $r_1$. Heaters 60 are selectively activated at various frequencies according to image data, causing filaments of working fluid 120 to break up into streams of individual ink droplets. Coalescence of drops often occurs in forming non-printing drops 95, 105 and 110. This region of jet break-up and drop coalescence is designated as $r_2$.

Following region $r_2$, drop formation is complete in region $r_3$, and small printing drops and large non-printing drops are spatially separated. Beyond this region in $r_4$, aerodynamic effects can cause merging of adjacent small and large drops, with concomitant loss of imaging information. A discrimination force 130 is provided by a gas flow at a non-zero angle with respect to axes $X_1$ and $X_2$. For example, the gas flow may be perpendicular to axes $X_1$ and $X_2$. Discrimination force 130 acts over distance L, which is less than or equal to distance $r_3$. Large, non-printing drops 95, 105, and 110 have greater masses and more momentum than small volume drops 100. As gas force 130 interacts with the stream of ink droplets, the individual ink droplets separate, depending on individual volume and mass. The gas flow rate can be adjusted to provide sufficient deviation $D_1$ or $D_2$ between the small droplet paths $S_1$ and $S_2$ and the large droplet paths $K_1$ and $K_2$, thereby permitting small drops 100 to strike print media W while large, non-printing drops 95, 105, and 110 are captured by a ink guttering structure described below.

Figure 4:
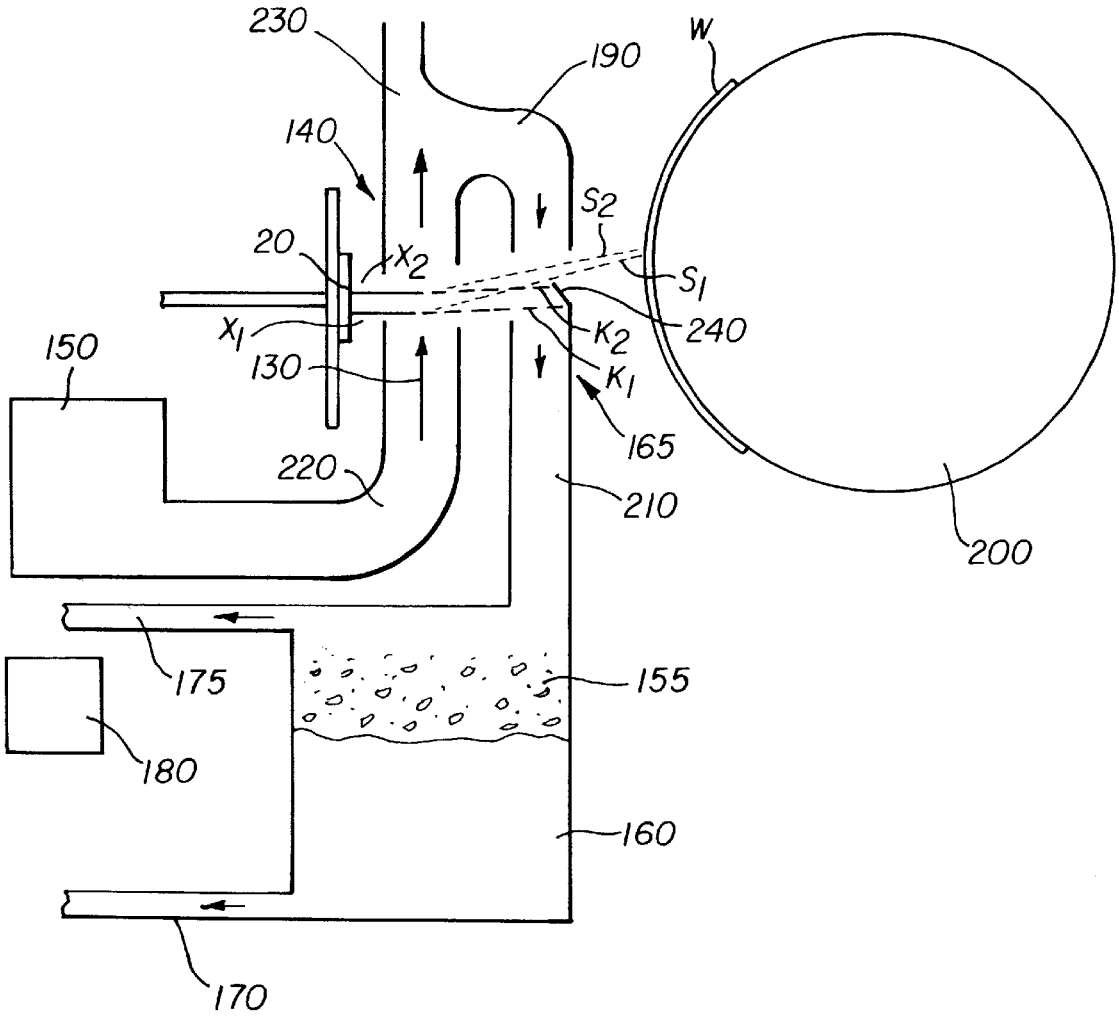
FIG. 4 is a schematic view of an ink jet printer made in accordance with a preferred embodiment of the present invention.

Referring to FIG. 4, a printing apparatus (typically, an ink jet printer or print head) used in a preferred implementation of the current invention is shown schematically. The print head here contains two rows of nozzles. The larger-nozzle row is the higher in the drawing. Large volume ink drops 95, 105 and 110 (FIG. 2) and small volume ink drops 100 (also FIG. 2) are formed from ink ejected in streams from print head 20 substantially along ejection paths $X_1$ and $X_2$. A droplet deflector 140 contains upper plenum 230 and lower plenum 220 which facilitate a laminar flow of gas in droplet deflector 140. Pressurized air from pump 150 enters upper plenum 230 which is disposed opposite plenum 220 and promotes laminar gas flow while protecting the droplet stream moving along paths $X_1$ and $X_2$ from external air disturbances. The application of force 130 due to gas flow separates the ink droplets into small-drop paths $S_1$ and $S_2$ and large-drop paths $K_1$ and $K_2$.

An ink collection structure 165, disposed adjacent to plenum 220 near paths $X_1$ and $X_2$, intercepts both paths $K_1$ and $K_2$ of large drops 95, 105, and 110, while allowing small ink drops 100 traveling along small droplet paths $S_1$ and $S_2$ to continue on to the recording media W carried by print drum 200. Since paths $S_1$ and $S_2$ do not necessarily intersect at the surface of the recording media W, and the droplets moving on paths $S_1$ and $S_2$ may not have the same velocity, printing of a pixel may not involve the simultaneous arrival of drops originating from nozzles 25 and 35. Controller 40 therefore, provides a compensating delay function so that proper registration of drops will occur.

Large, non-printing ink drops 95, 105, and 110 strike ink catcher 240 in ink collection structure 165. Ink recovery conduit 210 communicates with recovery reservoir 160 to facilitate recovery of non-printed ink droplets by an ink return line 170 for subsequent reuse. A vacuum conduit 175, coupled to negative pressure source 180 can communicate with ink recovery reservoir 160 to create a negative pressure in ink recovery conduit 210 improving ink droplet separation and ink droplet removal as discussed above. The pressure reduction in conduit 210 is sufficient to draw in recovered ink, however it is not large enough to cause significant air flow to substantially alter drop paths $S_1$ and $S_2$. Ink recovery reservoir contains open-cell sponge or foam 155, which prevents ink sloshing in applications where the print head 20 is rapidly scanned.

A small portion of the gas flowing through upper plenum 230 is re-directed by plenum 190 to the entrance of ink recovery conduit 210. The gas pressure in droplet deflector 140 is adjusted in combination with the design of plenum 220 and 230 so that the gas pressure in the print head assembly near ink catcher 240 is positive with respect to the ambient air pressure near print drum 200. Environmental dust and paper fibers are thusly discouraged from approaching and adhering to ink catcher 240 and are additionally excluded from entering ink recovery conduit 210.

In operation, a recording media W is transported in a direction transverse to axes $X_1$ and $X_2$ by print drum 200 in a known manner. Transport of recording media W is coordinated with movement of print mechanism 10 and/or movement of print head 20. This can be accomplished using controller 40 in a known manner. Recording media W may be selected from a wide variety of materials including paper, vinyl, cloth, other fibrous materials, etc.

It will be understood that the principle of the printing operation can be reversed (depending on imaging requirements), where the larger droplets are used for printing, and the smaller drops recycled. An example of this mode is presented in FIG. 5. In this example, only one printing drop is provided for per image pixel, thus there are two states of heater 60 actuation, printing or non-printing. The electrical waveform of heater 60 actuation for the printing case is presented schematically in line (a) of FIG. 5. The individual large ink drops 95 resulting from the jetting of ink from nozzles 25 and 35, in combination with this heater actuation, are shown schematically in line (b) of FIG. 5. Heater 60 activation time 65 is typically about 0.1 to about 5 microseconds in duration, and in this example is 1.0 microsecond. The delay time 80 between heater 60 actuations is 42 microseconds in the illustrative embodiment. The electrical waveform of heater 60 activation for the non-printing case is given schematically in line (c) of FIG. 5. Electrical pulse 65 is 1.0 microsecond in duration, and the time delay 83 between activation pulses is 6.0 microseconds in the illustrative example. Small drops 100, as diagrammed in line (d) of FIG. 5, are the result of the activation of heater 60 with this non-printing waveform.

Figure 5:
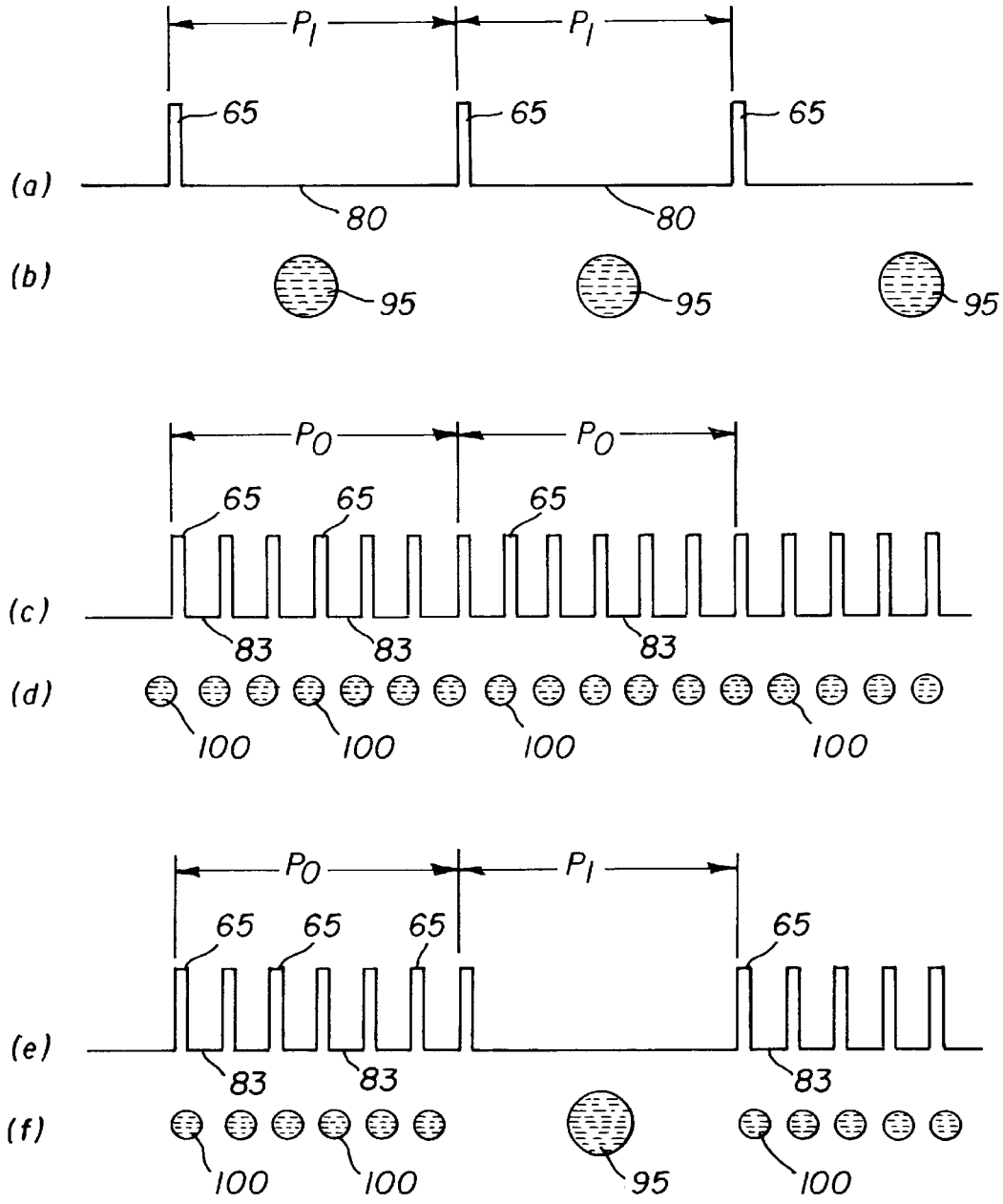
FIG. 5 consists of diagrams illustrating a frequency control of a heater used in an alternate embodiment of the present invention.
Figure 6:
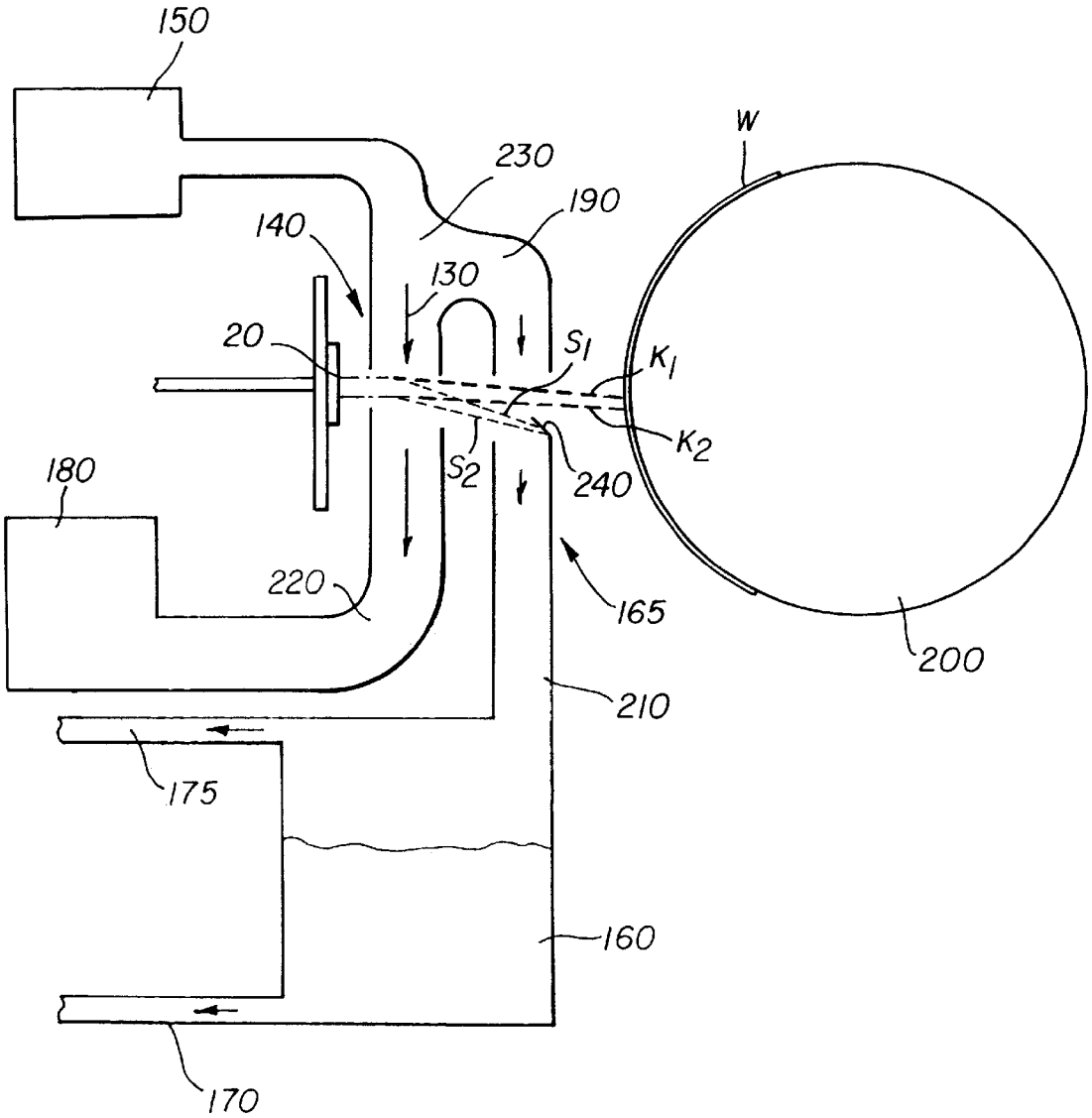
FIG. 6 is a schematic view of an ink jet printer made in accordance with another embodiment of the present invention.

Line (e) of FIG. 5 schematically represents the electrical waveform of heater 60 activation for mixed image data where a transition is shown for the non-printing state, to the printing state, and back to the non-printing state. Schematic representation in line (f) of FIG. 5 is the resultant droplet stream formed. It is apparent that heater 60 activation may be controlled independently based on the ink color required and ejected through corresponding nozzles 25 and 35, movement of print head 20 relative to a print media W, and an image to be printed Referring to FIG. 6, an alternative embodiment of the present invention is shown with like elements being described using like reference signs. As in the preceding example, the print head contains two rows of nozzles. However, in this implementation the smaller-nozzle row is the higher in the drawing. Large volume ink drops 95 and small volume ink drops 100 are formed from ink ejected from print head 20 substantially along ejection paths $X_1$ and $X_2$ in streams. A droplet deflector 140 contains upper plenum 230 and lower plenum 220 which facilitate a laminar flow of gas in droplet deflector 140. Pressurized air from pump 150 enters upper plenum 230 which is disposed opposite plenum 220 and promotes laminar gas flow while protecting the droplet streams moving along paths $X_1$ and $X_2$ from external air disturbances. Negative pressure source 180 communicates with plenum 220 and provides a sink for gas flow. In the center of droplet deflector 140 is positioned proximate paths $X_1$ and $X_2$. The application of force 130, due to gas flow, separates the ink droplets into small-drop paths $S_1$ and $S_2$ and large-drop paths $K_1$ and $K_2$.

An ink collection structure 165, adjacent to plenum 220, near paths $X_1$ and $X_2$, intercepts the path of small drops 100 moving along paths $S_1$ and $S_2$, while allowing large ink drops 95 traveling along large droplet paths $K_1$ and $K_2$ to continue on to the recording media W carried by print drum 200. Small ink drops 100 strike ink catcher 240 in ink collection structure 165. Ink recovery conduit 210 communicates with recovery reservoir 160 to facilitate recovery of non-printed ink droplets by an ink return line 170 for subsequent reuse. A vacuum conduit 175, coupled to negative pressure source 180 can communicate with ink recovery reservoir 160 to create a negative pressure in ink recovery conduit 210 improving ink droplet separation and ink droplet removal as discussed above. The pressure reduction in conduit 210 is sufficient to draw in recovered ink. However it is not large enough to cause significant air flow to substantially alter drop paths $K_1$ and $K_2$. Ink captured by element 150 to move downward, largely through the interior of element 150, and enter into ink recovery reservoir 90. Ink is then removed from reservoir 90 through line 100 for reuse.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An apparatus for printing an image comprising:

a print head having:

a first group of nozzles from which a stream ink droplets of a first volume are emitted, and a second group of nozzles from which a stream of ink droplets of a second volume are emitted, said second volume being less than said fist volume;

a mechanism associated with each group of nozzles adapted to independently adjust the volume of the ink droplets emitted by the nozzles, said mechanism having:

a first state wherein the volumes of the droplets emitted from said first and second groups are of the first and second volume, respectively, and a second state wherein the volumes of the droplets emitted from said first and second groups are of a third and forth volume, respectively, said third and forth volumes being smaller than said first and second volumes a droplet deflector adapted to produce a force on the emitted droplets, said force being applied to the droplets at an angle with respect to said stream of ink droplets to cause:

ink droplets having either of said first and second volumes to move along a first set of paths, and ink droplets having either of said third and forth volumes to move along a second set of paths; and an ink catcher positioned to allow drops moving along one of said first and second sets of paths to move unobstructed past the catcher, while intercepting drops moving along the other of said first and second sets of paths.

2. An apparatus as set forth in claim 1 wherein the droplet deflector is a gas source positioned at an angle with respect to said stream of ink droplets operable to interact with said streams of ink droplets.

3. An apparatus as set forth in claim 1 wherein the second group of nozzles is spaced from the first group of nozzles in a direction from which said force is applied to the droplets.

4. An apparatus as set forth in claim 3 wherein the second group of nozzles is spaced from the first group of nozzles by a distance from about 20 micrometers to about 10 mm.

5. An apparatus as set forth in claim 3 wherein the second group of nozzles is spaced from the first group of nozzles by a distance from about 50 micrometers to about 150 micrometers.

6. An apparatus as set forth in claim 1 wherein the nozzles of the second group of nozzles have a smaller cross sectional area than the nozzles of the first group.

7. An apparatus as set forth in claim 6 wherein the nozzles of the second group of nozzles have a diameter of about 9 micrometers and the nozzles of the first group of nozzles have a diameter of about 16 micrometers.

8. An apparatus as set forth in claim 1 wherein the mechanism adapted to adjust the volume of the ink droplets emitted by the nozzles comprises a respective heater associated with each nozzle.

9. An apparatus as set forth in claim 8 wherein the mechanism adapted to adjust the volume of the ink droplets emitted by the nozzles comprises a controller which activates the heaters with an electrical waveform of selectable period.

10. An apparatus as set forth in claim 8 wherein the mechanism adapted to adjust the volume of the ink droplets emitted by the nozzles comprises a controller which activates the heaters with an electrical waveform of selectable period, a relatively long period being said first state wherein the volumes of the droplets emitted from said first and second groups are of the first and second volume, respectively, and a relatively short period being said second state wherein the volumes of the droplets emitted from said first and second groups are of a third and forth volume, respectively, said third and forth volumes being smaller than said first and second volumes.

11. An apparatus for printing an image comprising:

a first plurality of nozzles for printing ink of a predetermined color and a second plurality of drop-emitter nozzles of different radius from said first plurality of nozzles, said second plurality of nozzles being adapted to print ink drops of the predetermined color, both said first and second plurality of nozzles operable to selectively create a stream of ink droplets having a plurality of volumes; and a droplet deflector having a gas source positioned at an angle with respect to said stream of ink droplets operable to interact with said stream of ink droplets, thereby separating ink droplets having one of said plurality of volumes from ink droplets having another of said plurality of volumes; and an ink catcher which allows a plurality of drops moving on a printing path to strike a receiver media, while preventing drops moving along a non-printing path from reaching the receiver media.

12. A process for printing an image using a print head having a first group of nozzles from which a stream ink droplets of a first volume are emitted, and a second group of nozzles from which a stream of ink droplets of a second volume are emitted, said second volume being less than said first volume; said method comprising the steps of:

independently adjusting the volume of the ink droplets emitted by the nozzles between a first state wherein the volumes of the droplets emitted from said first and second groups are of the first and second volume, respectively, and a second state wherein the volumes of the droplets emitted from said first and second groups are of a third and forth volume, respectively, said third and forth volumes being smaller than said first and second volumes deflecting the emitted droplets with a force applied to the droplets at an angle with respect to said stream of ink droplets, whereby ink droplets having either of said first and second volumes move along a first set of paths, and ink droplets having either of said third and forth volumes to move along a second set of paths; and intercepting drops moving along the one of said first and second sets of paths while allowing drops moving along the other of said first and second sets of paths to move unobstructed to a receiver medium.

* * * * *